US011118385B2

(12) United States Patent
Hawkinson et al.

(10) Patent No.: US 11,118,385 B2
(45) Date of Patent: Sep. 14, 2021

(54) INTEGRATED GUIDE SYSTEM AND DOOR SEAL FOR A SOFT CLOSE SLIDING DOOR

(71) Applicant: ASSA ABLOY Accessories and Door Controls Group, Inc., New Haven, CT (US)

(72) Inventors: William Hawkinson, Germantown, TN (US); Philip Anthony Goossens, Cordova, TN (US)

(73) Assignee: ASSA ABLOY Accessories and Door Controls Group, Inc., Monroe, NC (US)

( * ) Notice: Subject to any disclaimer, the term of this patent is extended or adjusted under 35 U.S.C. 154(b) by 162 days.

(21) Appl. No.: 16/104,535

(22) Filed: Aug. 17, 2018

(65) Prior Publication Data

US 2019/0309551 A1 Oct. 10, 2019

Related U.S. Application Data

(60) Provisional application No. 62/654,662, filed on Apr. 9, 2018.

(51) Int. Cl.

| | |
|---|---|
| ***E05D 15/06*** | (2006.01) |
| ***E06B 7/18*** | (2006.01) |
| ***E05F 5/00*** | (2017.01) |
| ***E06B 7/23*** | (2006.01) |
| ***E06B 7/215*** | (2006.01) |

(52) U.S. Cl.

CPC ..... *E05D 15/063* (2013.01); *E05D 15/0656* (2013.01); *E05F 5/003* (2013.01); *E06B 7/18* (2013.01); *E06B 7/215* (2013.01); *E06B 7/23* (2013.01); *E06B 7/2312* (2013.01); *E06B 7/2316* (2013.01)

(58) Field of Classification Search

CPC .... E05F 5/003; E05D 15/063; E05D 15/0656; E06B 7/21; E06B 7/215

See application file for complete search history.

(56) References Cited

U.S. PATENT DOCUMENTS 4,604,831 A * 8/1986 Tunnicliffe ..... E06B 3/44 49/404

5,566,505 A * 10/1996 Kamezaki ..... E05D 15/1021 49/225

(Continued)

FOREIGN PATENT DOCUMENTS

DE 2462185 A1 * 4/1976 ..... E06B 7/2314

*Primary Examiner* — Catherine A Kelly

(74) *Attorney, Agent, or Firm* — Moore & Van Allen PLLC; Jeffrey R. Gray

(57) ABSTRACT

A door system includes a door having a housing mounted in the bottom edge of the door that retains a bottom seal and a second channel for receiving a guide. A seal is formed adjacent the periphery of the door between the door and a door opening in a structure when the door is in the closed position. The seal includes deformable gaskets that extend between the structure and the door to form a seal around the door opening. A first soft close device is mounted adjacent the open positon and a second soft close device is mounted adjacent the closed position. A single activator pin is mounted on the door and positioned such that the activator pin engages the first soft close device as the door nears the open positon and engages the second soft close device as the door nears the closed position.

13 Claims, 19 Drawing Sheets

(56) References Cited

U.S. PATENT DOCUMENTS

| | | | | |
|---|---|---|---|---|
| 6,125,584 | A * | 10/2000 | Sanders | E06B 7/215 49/310 |
| 7,866,003 | B2 * | 1/2011 | Tooyama | E05F 5/003 16/422 |
| 8,272,167 | B2 * | 9/2012 | Sato | E05F 1/16 49/404 |
| 8,307,497 | B2 * | 11/2012 | Chang | E05F 5/003 16/49 |
| 8,915,020 | B2 * | 12/2014 | Sauter | E06B 7/2318 187/400 |
| 8,955,271 | B2 * | 2/2015 | Keller | E05B 65/006 52/207 |
| 9,863,178 | B2 * | 1/2018 | Wang | E05F 5/02 |
| 9,869,115 | B2 * | 1/2018 | Nilsson | E05D 15/0643 |
| 9,885,206 | B2 * | 2/2018 | Shin | E05F 1/16 |
| 10,455,989 | B2 * | 10/2019 | Wei | E06B 3/4636 |
| 2013/0167444 | A1 * | 7/2013 | Ryden | E05F 1/16 49/417 |
| 2016/0369547 | A1 * | 12/2016 | Sato | E06B 3/4654 |
| 2019/0119967 | A1 * | 4/2019 | Torrabias Cantal | E05F 5/003 |
| 2019/0368266 | A1 * | 12/2019 | Goldfinch | E05D 15/0626 |
| 2021/0010309 | A1 * | 1/2021 | Montecchio | E05F 5/003 |

* cited by examiner

INTEGRATED GUIDE SYSTEM AND DOOR SEAL FOR A SOFT CLOSE SLIDING DOOR

This application claims benefit of priority under 35 U.S.C. § 119(e) to the filing date of U.S. Provisional Application No. 62/654,662, as filed on Apr. 9, 2018, which is incorporated herein by reference in its entirety.

This invention relates generally to sliding doors and more particularly to soft close sliding doors and sliding doors having a sealing assembly.

BACKGROUND

A sliding door may be mounted on a track that allows the door to slide laterally relative to a door opening between an open positon and a closed position. In the open position the door is spaced from the opening to allow ingress and egress through the door opening and in the closed positon the door covers the opening to prevent ingress and egress through the door opening. A typical sliding door may be freely movable along the track such that the door is manually slid laterally between the open and closed positions. In certain circumstances the sliding door can approach the open and closed positions with an undesirable amount of force because the door is freely movable and the force applied to the door is variable. As a result, soft close systems have been developed that control the movement of the door as it reaches the fully open and/or fully closed positions. In some situations it is desirable to provide a door having a seal such that when the door is in the closed position the door is sealed to prevent or substantially reduce the transmission of air, sound, debris and the like across the door opening. In some embodiments the sealing system includes a bottom seal that engages the floor when the door is in the closed position.

SUMMARY

In some embodiments, a sliding door system comprises a door comprising a top edge, a leading edge and a trailing edge mounted for sliding movement relative to a door opening formed in a structure between a closed positon and an open position. A housing is mounted in the bottom edge of the door where the housing comprises a first channel retaining a bottom seal and a second channel receiving a guide. A bottom seal is positioned in the second channel comprising a sealing member that is moved vertically between a retracted position and an extended position.

A seal may be formed adjacent the top edge, the leading edge and the trailing edge between the door and the door opening when the door is in the closed position. A first soft close device may be mounted adjacent the open positon and a second soft close device may be mounted adjacent the closed position. An activator pin may mounted on the door and positioned such that the activator pin contacts the first soft close device as the door nears the open positon and contacts the second soft close device as the door nears the closed position. The seal may comprise a first deformable gasket mounted on the door that extends to the structure to form a seal against the structure adjacent door opening. The seal may comprise a deformable gasket mounted on the structure that extends to the door to form a seal against the door adjacent door opening. A channel member may be disposed generally vertically to receive the leading edge of the door when the door is in the closed position. The channel member may comprise a gasket that faces the door such that when the door is in the closed position and the leading edge of the door is received in the channel, the gasket engages the door near the leading edge.

In some embodiments a door assembly comprises a door mounted for lateral sliding movement between an open position and a closed position. A first soft close device is mounted adjacent the open positon and a second soft close device is mounted adjacent the closed position. An activator pin is mounted on the door and is positioned such that the activator pin contacts the first soft close device as the door nears the open position and contacts the second soft close device as the door nears the closed position. The activator pin may be mounted to a top edge of the door. The activator pin may comprise a threaded end that is threaded into a threaded apron on the door such that rotation of the activator pin changes the height of the activator pin relative to the door. The activator pin may be located in the center of the door. The door may have a leading edge and a trailing edge where the activator pin is positioned approximately midway between the leading edge and the trailing edge. A first trolley may be mounted to a top edge of the door and a second trolley may be mounted to the top edge of the door the second trolley is spaced laterally from the first trolley. The activator pin may be mounted to the top edge of the door approximately midway between the first trolley and the second trolley. The door may be positioned at or offset from the approximate vertical centerline of the door. The first and second soft close devices may be positioned such that when the door is at the halfway point of travel between the fully open position and the fully closed position, the soft close devices are spaced approximately equally from the activator pin allowing for overlap of the door opening.

In some embodiments, a door for use in a sliding door assembly comprises a first trolley mounted to a top edge of the door; a second trolley mounted to the top edge of the door and spaced from the first trolley; and an activator pin mounted to the top edge of the door approximately midway between the first trolley and the second trolley.

In some embodiments, a method of operating a door assembly is provided where the door assembly comprises a door mounted for lateral sliding movement between an open position and a closed position, a first soft close device mounted adjacent the open positon, a second soft close device mounted adjacent the closed position, and an activator pin mounted on the door. The method comprises moving the door in a first direction such that the activator pin contacts the first soft close device as the door nears the open positon and moving the door in a second direction such that the activator pin contacts the second soft close device as the door nears the closed position.

In some embodiments an integrated door guide system comprises a housing comprising a first channel for retaining a door seal and a second channel for receiving a guide where the first channel is disposed parallel to and adjacent the second channel. A guide is received in the second channel such that the guide does not extend under the door seal.

The guide may comprise a guide member having a first side that faces the first channel and a second side that faces away from the first channel and a support supporting the guide member where the support extends away from the second side. The first channel and the second channel may share a common wall. A bottom seal may positioned in the second channel. The bottom seal may comprise a sealing member that is moved vertically between a retracted and extended position.

In some embodiments, a sliding door system comprises a door mounted for sliding movement. A housing is mounted in the bottom edge of the door where the housing comprises a first channel retaining a bottom seal and a second channel for receiving a guide. The first channel is disposed parallel to and adjacent the second channel. A guide member is received in the second channel where the guide member has a first side that faces the first channel and a second side that faces away from the first channel. A support supports the guide and extends away from the second side such that the support does not extend under the bottom seal.

The door may have a width and the first channel and the second channel may extend along the length of the housing and for the width of the door where both channels open toward a bottom of the door. The first channel and the second channel may share a common wall. The guide member may comprise an upright member. The bottom seal may comprise a sealing member that is moved vertically between a retracted and extended position. The support member may be positioned such that it extends away from and behind the sealing member. The support member may comprise an L-shaped member having a horizontal portion and a vertical portion.

DETAILED DESCRIPTION

Figure 1:
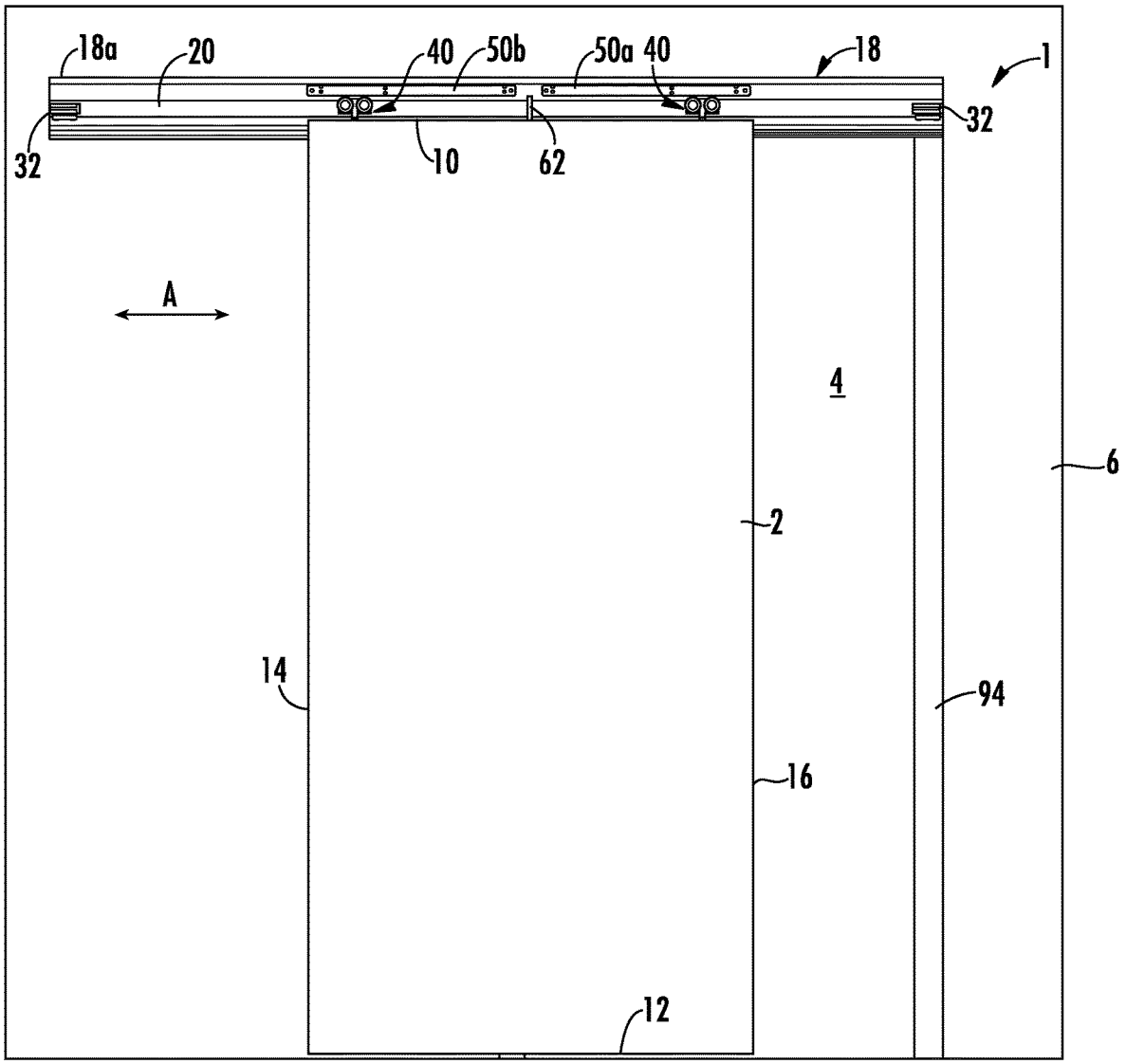
FIG. 1 is a plan view of an embodiment of a portion of a door assembly in a partially open position according to the present invention.
Figure 2:
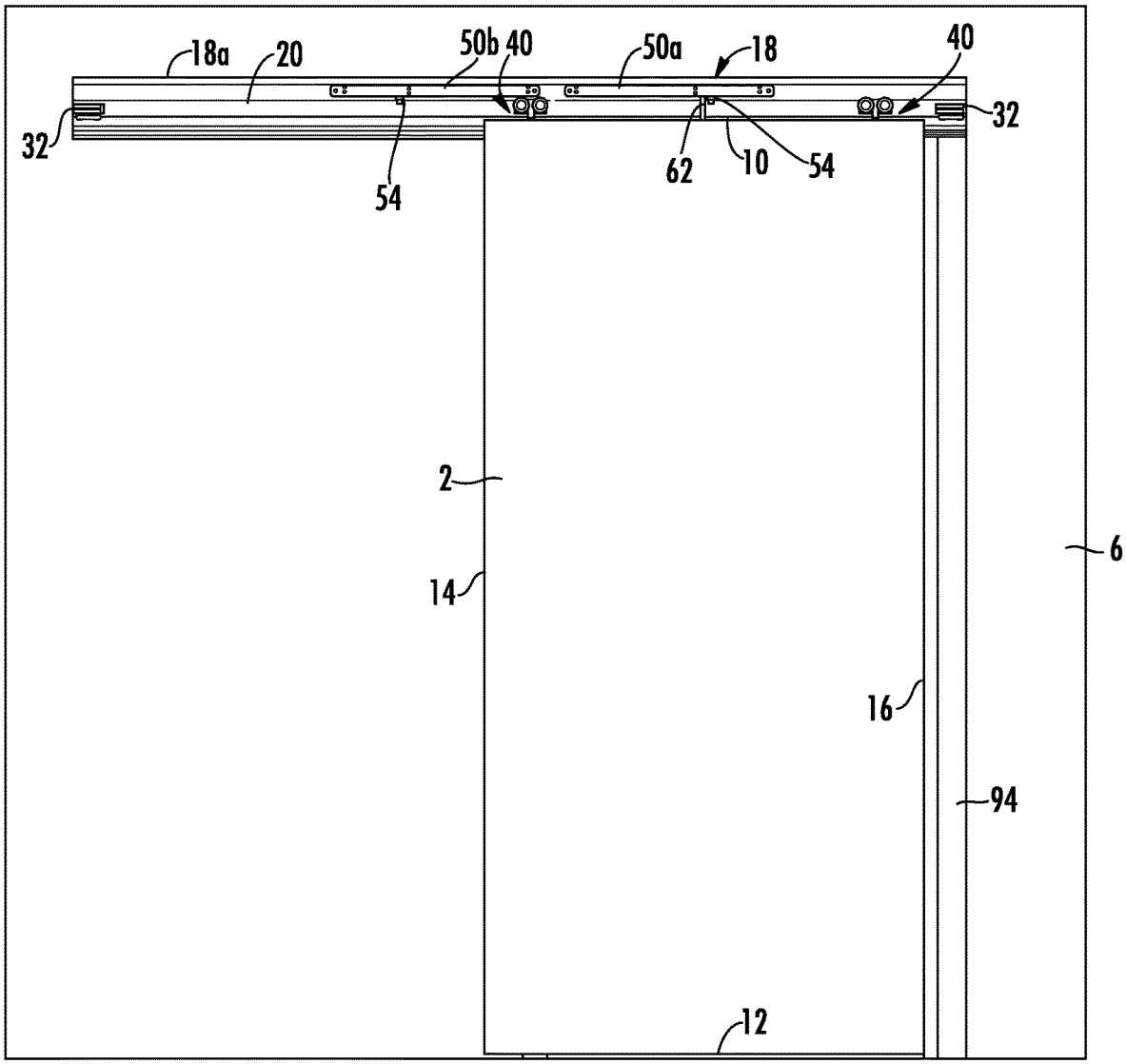
FIG. 2 is a plan view of the door assembly of FIG. 1 in a near closed position.

Embodiments of the present invention now will be described more fully hereinafter with reference to the accompanying drawings. Referring to the figures, an embodiment of a sliding door assembly is shown. While one embodiment of a door assembly is shown and described, the inventions described herein may be used in door assemblies other than the embodiment specifically shown and described herein.

The door assembly is shown generally at 1 and comprises a door 2 mounted for movement relative to a door opening 4 formed in a wall or other structure 6. The door opening 4 may provide ingress to or egress from a room, building, or other structure. The opening 4 may be selectively opened or closed by moving the door 2 laterally relative to the opening 4 between a fully open positon and a fully closed position as represented by arrow A in FIG. 1. It will be appreciated that the door may assume partially open/closed positions between the fully open positon and the fully closed position.

The door 2 may comprise a generally planar member defining a top edge 10, bottom edge 12, a first or trailing edge 14 and a second or leading edge 16. The door may be made of any suitable material and may be provided in a variety of suitable finishes and styles to meet both aesthetic needs and utilitarian requirements such as sound, smoke, fire proofing or the like. To support the door 2 for movement relative to the wall 6 an elongated mounting bracket 18 is mounted to the wall 6 over the opening 4. The mounting bracket 18 is mounted substantially horizontally and may extend for the full length of travel of the door 2. The mounting bracket 18 may be secured to the wall 6 by fasteners such as screws or the like. A track 20 is mounted to the mounting bracket 18 such that it extends for the full length of travel of the door 2. In one embodiment, the mounting bracket 18 has an overhang portion 18*a*. The track 20 is mounted substantially horizontally and extends over the opening 4 such that it supports the door 2 between the fully open positon and the fully closed position. The mounting bracket 18 and track 20 may be made of a rigid, strong material such as, but not limited to, metal such as aluminum, steel, or the like, a plastic or polymer material or the like, or other suitable material, provided that the mounting bracket 18 and track 20 can support the door 2. The track 20 has a generally inverted U-shape cross section that includes downwardly extending support members 22 connected at their upper ends by a cross member 24. The cross member 24 may be secured to the overhang portion 18*a* of the support track 18 by fasteners 26 such as screws. The lower ends of the support members 22 terminate in inwardly extending support surfaces 28 that define a gap therebetween. Trollies 40 are supported on the support surfaces 28 and extend into the gap as will herein after be described.

Figure 6:
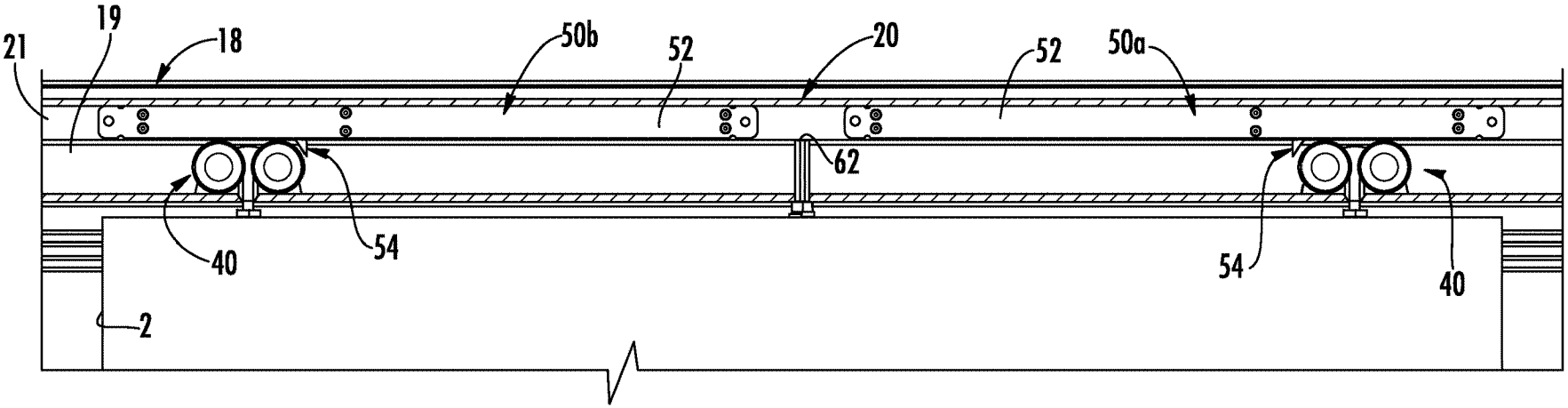
FIG. 6 is a detailed elevation view of the door assembly of FIG. 1 in a partially open position.
Figure 7:
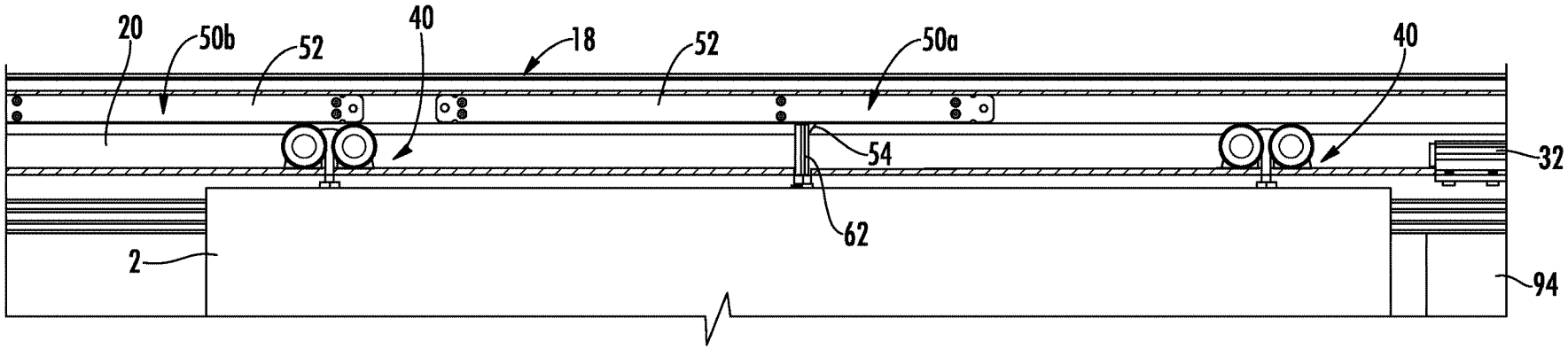
FIG. 7 is a detailed elevation view of the door assembly of FIG. 1 in a near closed position.

The support members 22 are formed to define a generally rectangular lower interior space 19 that communicates with the gap formed between the inwardly extending support surfaces 28 and a generally rectangular upper interior space 21 that communicates with the lower interior space, see FIGS. 1 and 6. The upper interior space 21 is dimensioned to retain the soft close devices 50*a*, 50*b* and the lower interior space is dimensioned to receive the trollies 40 and the stops 32 as will be hereinafter explained.

A front plate 30 may be secured to the mounting bracket and/or to the track to cover the support assembly and hide the internal components. The front plate 30 may be made of any suitable material and may be snap-fit to the mounting bracket 18 or it may be secured by separate fasteners. The front plate 30 may be provided in a variety of suitable finishes and styles to meet both aesthetic and utilitarian requirements.

Figure 10:
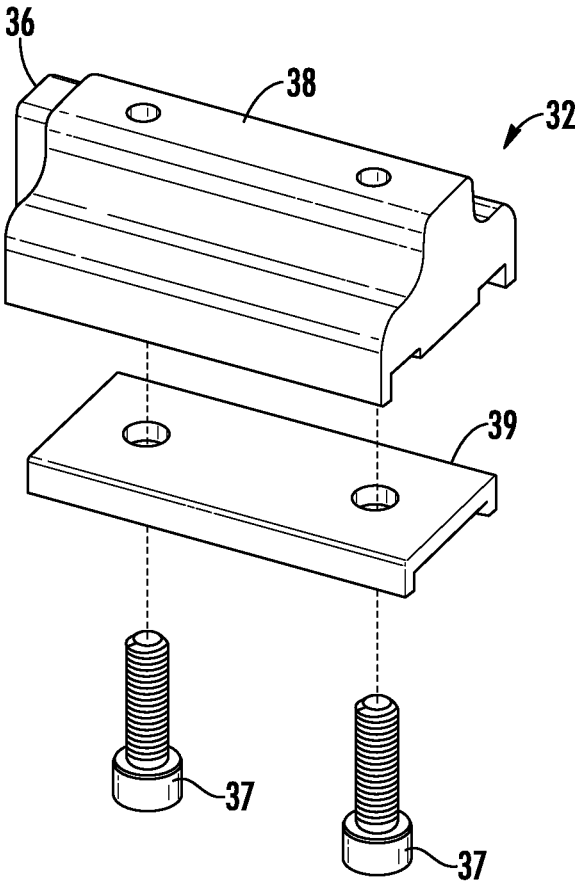
FIG. 10 is a detailed exploded perspective view of the stop of the door assembly of FIG. 1.
Figure 11:
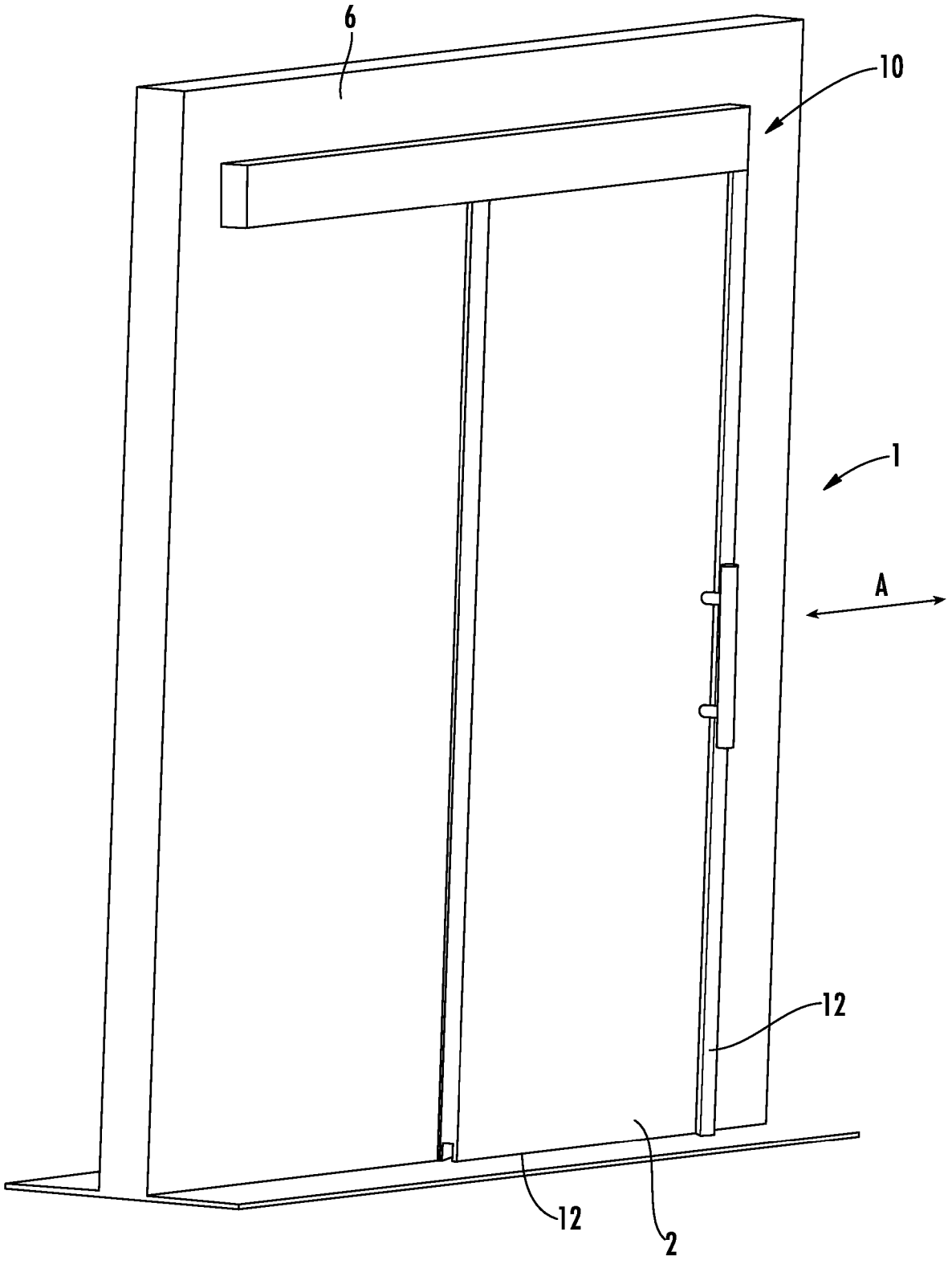
FIG. 11 is a perspective view of an embodiment of a door assembly in a closed position with an embodiment of the integrated guide assembly of the invention.
Figure 12:
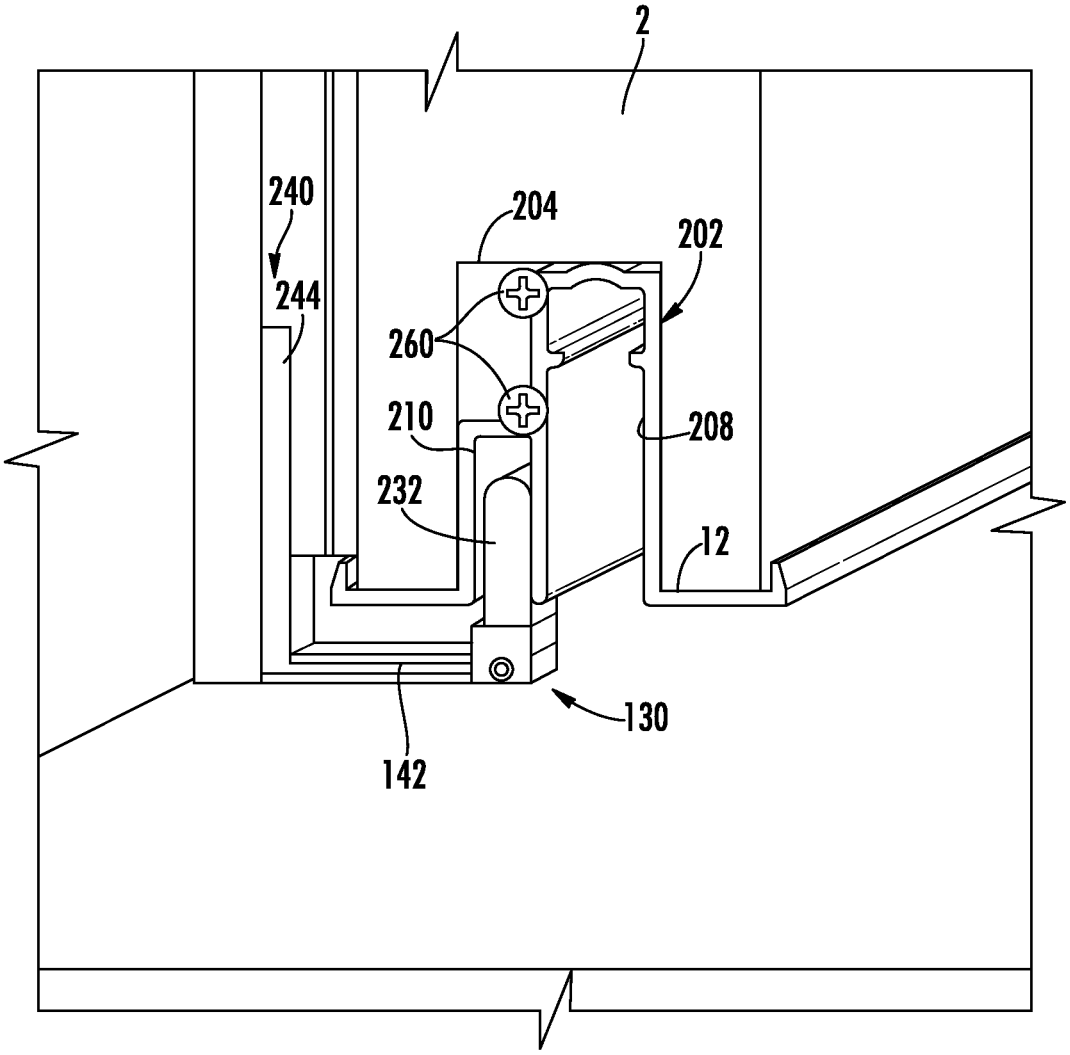
FIG. 12 is a detailed perspective view of the integrated guide assembly of FIG. 11.
Figure 13:
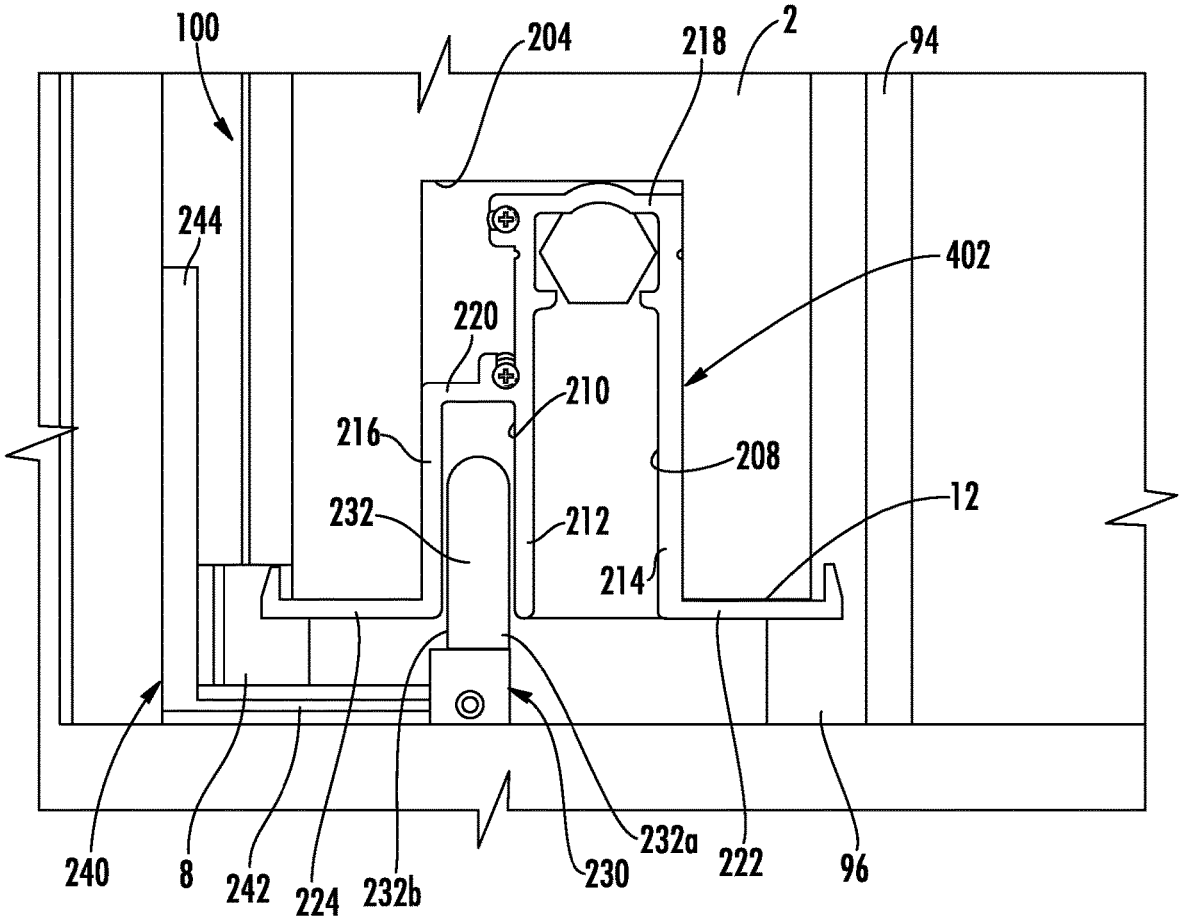
FIG. 13 is an end view of the integrated guide assembly of FIG. 11 with the bottom door seal removed.

A stop 32 may be secured to and supported at each end of the track 20 to close the track after the trollies 40 and soft close devices 50 are inserted into the track. Referring to FIG. 10 each stop 32 may comprise an elastomeric bumper or cushion 36 supported in a block 38 such that the bumper 36 extends from the block in a position where the trolley 40 may strike the bumper 36. Threaded members 37 threadably engage the block 38 and reverse threadably engage an opposing mounting bracket 39 such that rotation of the threaded members 37 forces the block 38 and plate 39 together. Block 38 is positioned in the lower interior space and plate 39 is positioned outside of and below the track 20 such that when the stops 32 are disposed in the track 20 and the block 38 and plate 39 are moved toward one another the support surfaces 28 of track 20 are clamped between the block 38 and plate 39. The stops 32 may be secured in the track by any suitable mechanism. An end plate 34 may be attached to each end of the mounting bracket 18 and front plate 30 such as by screws to complete the assembly. The end plates 34 may be provided in a variety of suitable finishes and styles to meet both aesthetic needs and utilitarian requirements such as sound, smoke, fire proofing or the like A frame 80 may be provided that defines or surrounds the opening 4. The frame 80 may be formed by individual frame members or caps 82, 84, 86 that fit over the opening 4 formed in wall 6 where the caps 82, 84, 86 may be secured to the wall by suitable fasteners. A greater or fewer number of frame members may be used. In other embodiments the frame 80 may be formed as part of the wall 6. The frame 80 may also comprise frame fascias 88, 90, 92, 102 that connect to the caps using a snap-fit connection separate fasteners or the like.

Figure 18:
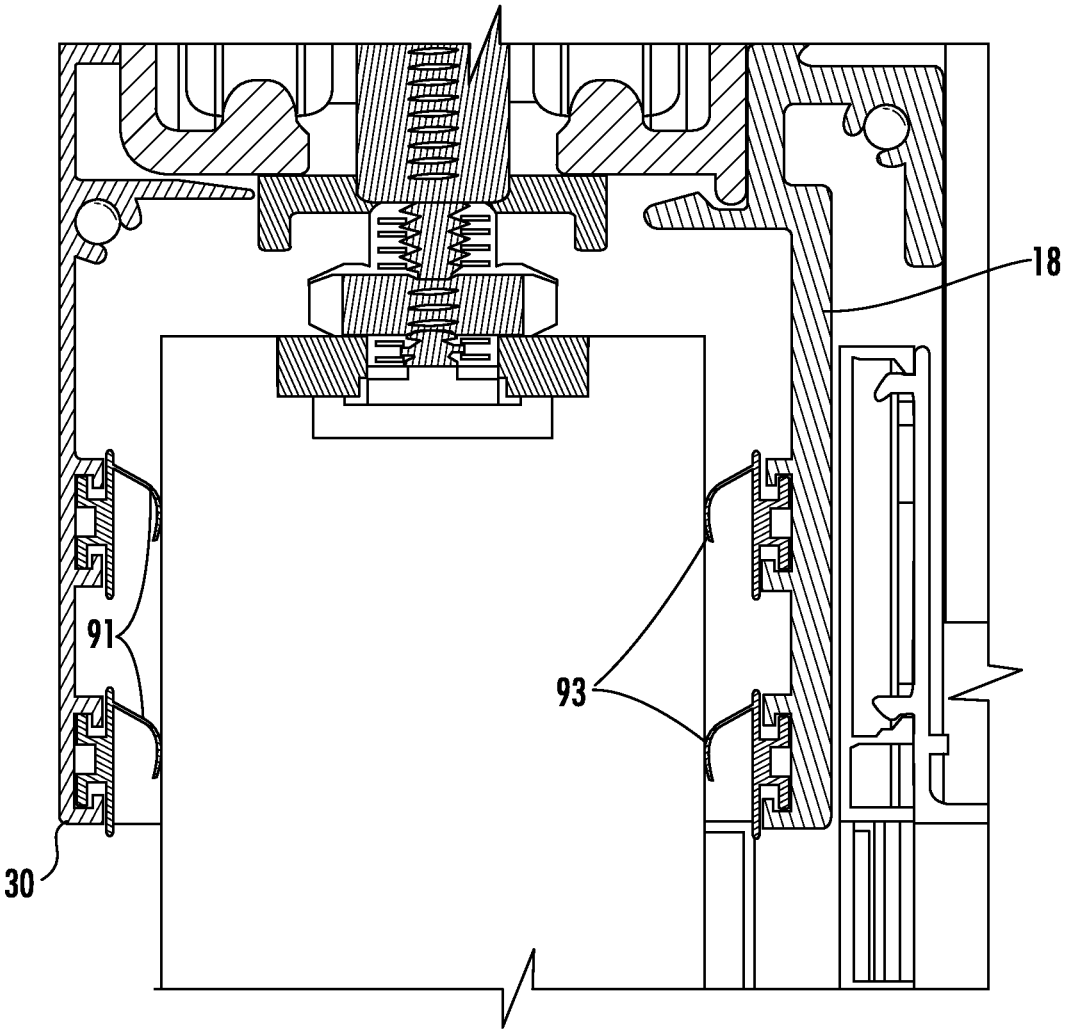
FIG. 18 is an end view of the top edge of the door.

In some embodiments, a seal between the door 2 and the wall 6 and door frame 4 is provided. The seal may create a barrier against sound, air, smoke, light, sightlines, debris or the like. Gaskets 91, 93, 96, 98, and 100 are provided to create the seal. The gaskets 91, 93, 96, 98 and 100 may be formed of any suitable compressible, resilient material such as rubber, polymer or the like. The gaskets 91, 93, 96, 98 and 100 create a seal around the periphery of the opening 4. In some embodiments each gasket 91, 93, 96, 98 and 100 may comprise at least one elongated sealing member that extends to the door to form a seal against the door. Referring to FIG. 18, gaskets 91 are supported in front plate 30 such that they extend along and engage the outer face of the door adjacent the top edge 10 of the door when the door is in the closed position. The gaskets 91 engage the front face of the door and are deformed into engagement with the front face to create the seal. The gaskets 91 may be supported in elongated slots or holders formed on the front plate 30 or by other securement mechanisms. Gaskets 93 are supported on mounting bracket 18 such that they extend along and engage the inner face of the door adjacent the top edge 10 of the door when the door is in the closed position. The gaskets 93 engage the inner face of the door and are deformed into engagement with the inner face to create the seal. The gaskets 93 may be supported in elongated slots or holders formed on the mounting bracket 18 or by other securement mechanisms.

Figure 19:
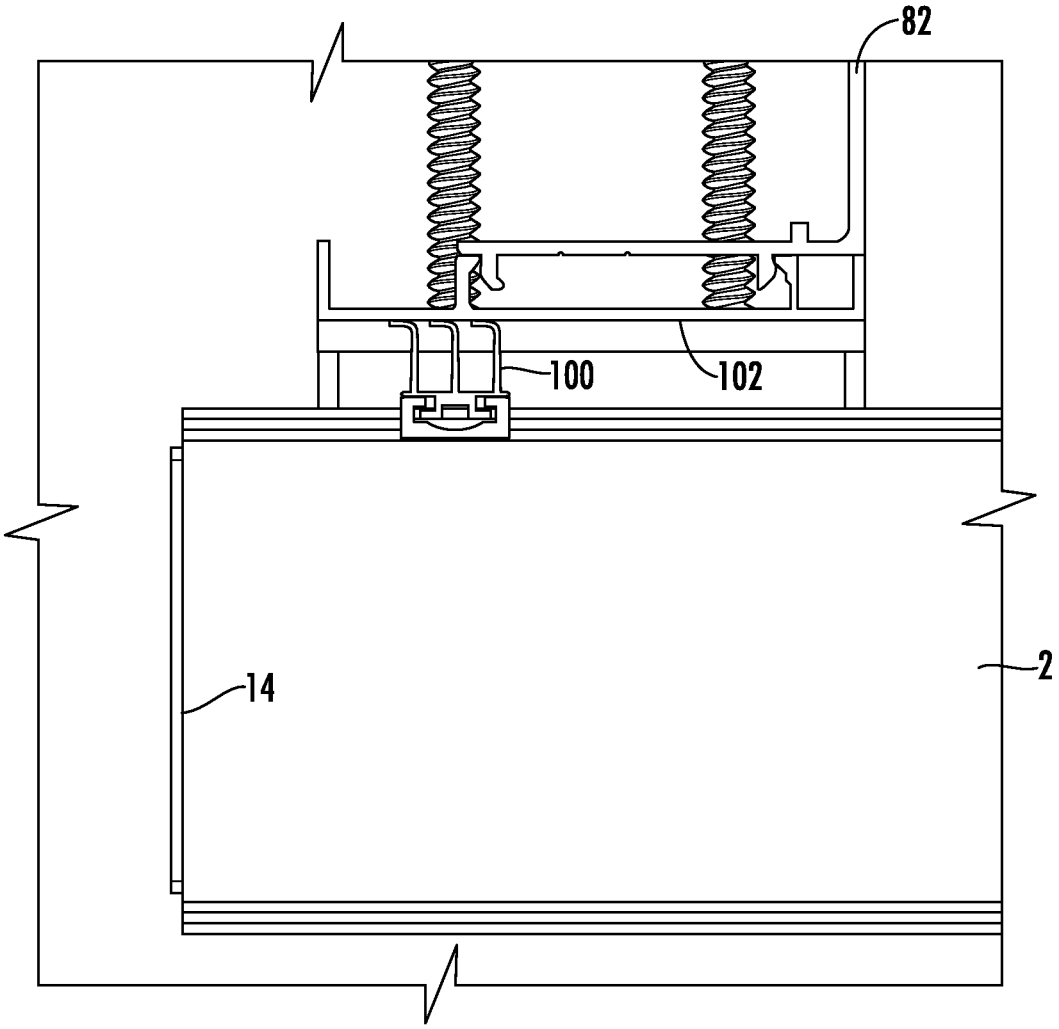
FIG. 19 is a top view of the trailing edge of the door in the closed position.

Referring to FIG. 19 gasket 100 is mounted to the back face of the door and extends for substantially the entire height of the door. The gasket 100 engages the facing surface of the wall 6 or fascia 102, as shown, and is deformed into engagement with the wall 6 or fascia 102 to create the seal along the trailing edge 14 of the door 2. The gasket 100 may be supported in elongated slots or holder 104 formed on or mounted to the door or by other securement mechanisms.

The seal may comprise a channel member 94 that is disposed generally vertically and faces the leading edge 16 of the door 2. The channel member 94 is dimensioned to receive the edge 16 of the door. The channel member 94 may comprise gaskets 96 and 98 that face both sides of the door such that when the door is in the closed position and the leading edge 16 of the door is received in the channel 94, gasket 96 engages the outer face of the door near leading edge 16 and gaskets 98 engage the inner face of the door near the leading edge 16 to create the seal. The gaskets 96 and 98 may be formed of any suitable compressible, resilient material such as rubber, polymer or the like. The gaskets 96 and 98 extend the height of the channel member 94 and door 2 to create a seal along the height of the door. In some embodiments each of the gaskets 96 and 98 may comprise at least one elongated sealing member that forms a seal against the door. The gaskets may be formed of any suitable compressible, resilient material such as rubber, polymer or the like. The gaskets 96 and 98 may be supported in elongated slots or holders formed on or mounted to the channel member 94 or by other securement mechanisms.

To seal the bottom of the door, the bottom edge of the door may include a bottom seal that is moved into engagement with the floor when the door is in the closed positon as will hereinafter be described. The arrangement of the gaskets as described above and the bottom seal create a door seal that extends about the periphery of the door to prevent the movement of air, sound, light, smoke or the like from moving through the door opening when the door is closed.

Referring to FIGS. 1-9, the door 2 is supported by and suspended from the trollies 40 where one of the trollies is mounted near the front edge 16 of the door and the other one of the trollies 40 is mounted near the rear edge 14 of the door. The trollies 40 are identical such that one of the trollies is described in detail. The trolley 40 comprises a carriage 42 that rotatably supports a plurality of wheels 44 that are disposed such that the wheels ride on the support surfaces 28 of track 20. The wheels 44 are arranged in pairs where in the illustrated embodiment, two pairs of wheels are provided. The trolley is mounted on the door using an apron assembly. The carriage 42 includes a threaded hole for receiving a threaded fastener 46 such as a screw such that the carriage 42 may be moved axially along the length of screw when the carriage 42 is rotated relative to the screw. A plate 48 is fixed to the top edge 10 of the door 4 trapping the head of screw between the door and the plate 48. The plate 48 may be positioned in a pocket 49 formed in the edge of the door such that the plate 48 is flush with the top edge 10. The plate 48 may be fixed to the top edge 10 of the door 4 by suitable fasteners such as screws that are inserted through holes 47 and threaded into the door. A lock nut 45 may be provided to clamp the plate 48 between the head of the screw 46 and the nut 45 to fix the screw in position. The carriage 42 may be threaded along the length of the screw 46 to adjust the position of the carriage 42 and wheels 44 relative to the door to position the door a set distance below the track and to adjust the positon of the door relative to the floor in order to account for variations in the construction of the door. The fastener 46 extends into the gap between the support surfaces 28 such that the wheels 44 are supported on to support surfaces 28.

An activator pin assembly 60 is mounted in the top edge 10 of the door 4 using a separate apron assembly from that used to mount the trollies 40 to the door. The activator pin assembly 60 comprises an activator pin 62 having a threaded end 62*a* that is threaded into a threaded sleeve 64. The threaded sleeve 64 is retained in a hole 66 formed in the top edge 10 of the door 4. A plate 66 may be fixed to the top edge of the door to retain the threaded sleeve 64 between the door and the plate and thereby fix the activator pin 62 to the door. The plate 66 may be positioned in a pocket 68 formed in the edge of the door 4 such that the plate 66 is flush with the surface of the top edge 10. The plate 66 may be fixed to the top edge of the door by suitable fasteners such as screws that are inserted through holes 68 and threaded into the door. A lock nut 70 and lock washer 72 may be provided to fix the position of the activator pin 62. Rotation of the activator pin 62 relative to sleeve 64 and lock nut 70 increases or decreases the height of the activator pin 62 relative to the top edge of the door such that the height of the pin is adjustable.

Figure 3:
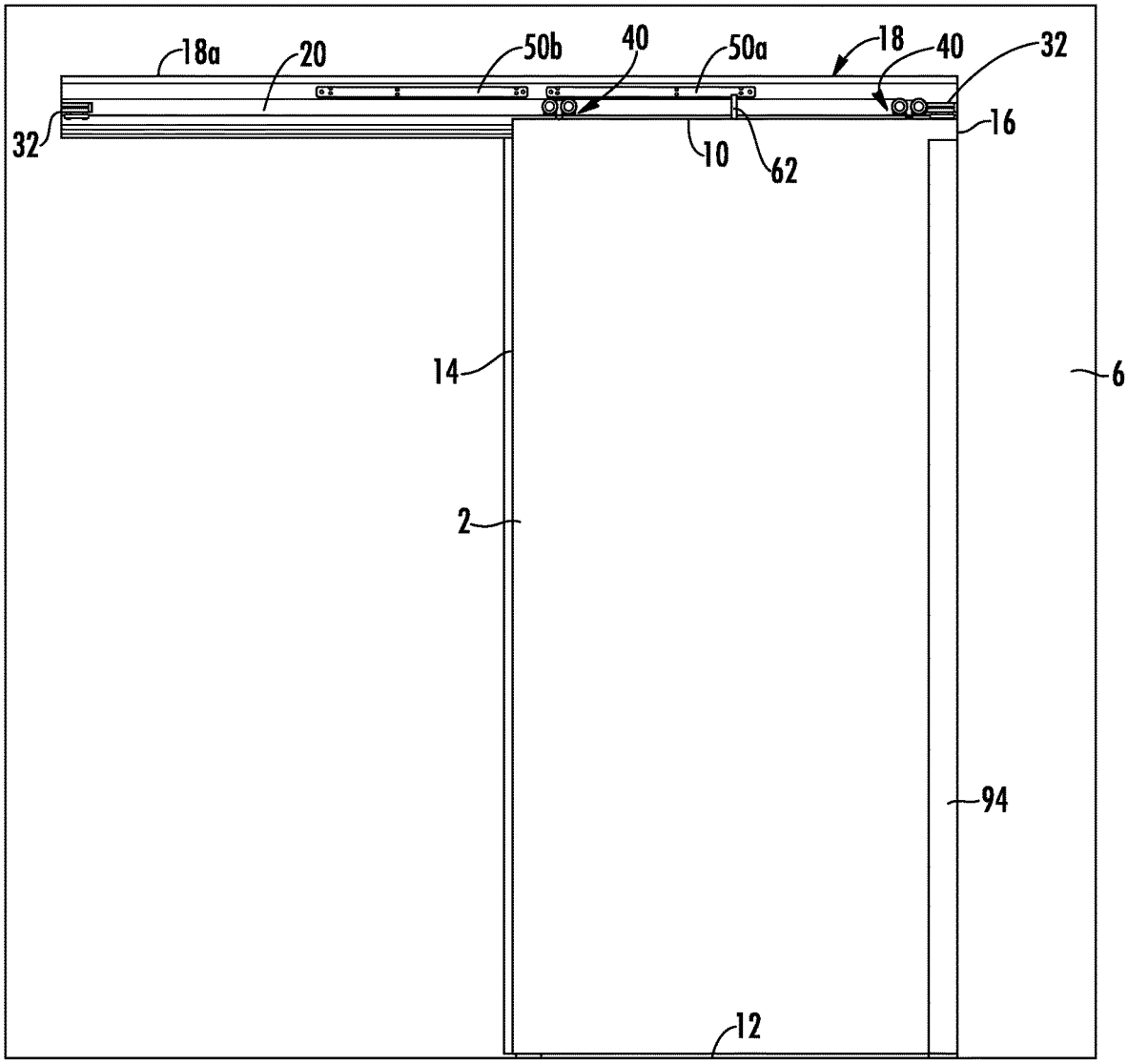
FIG. 3 is a plan view of the door assembly of FIG. 1 in a fully closed position.
Figure 4:
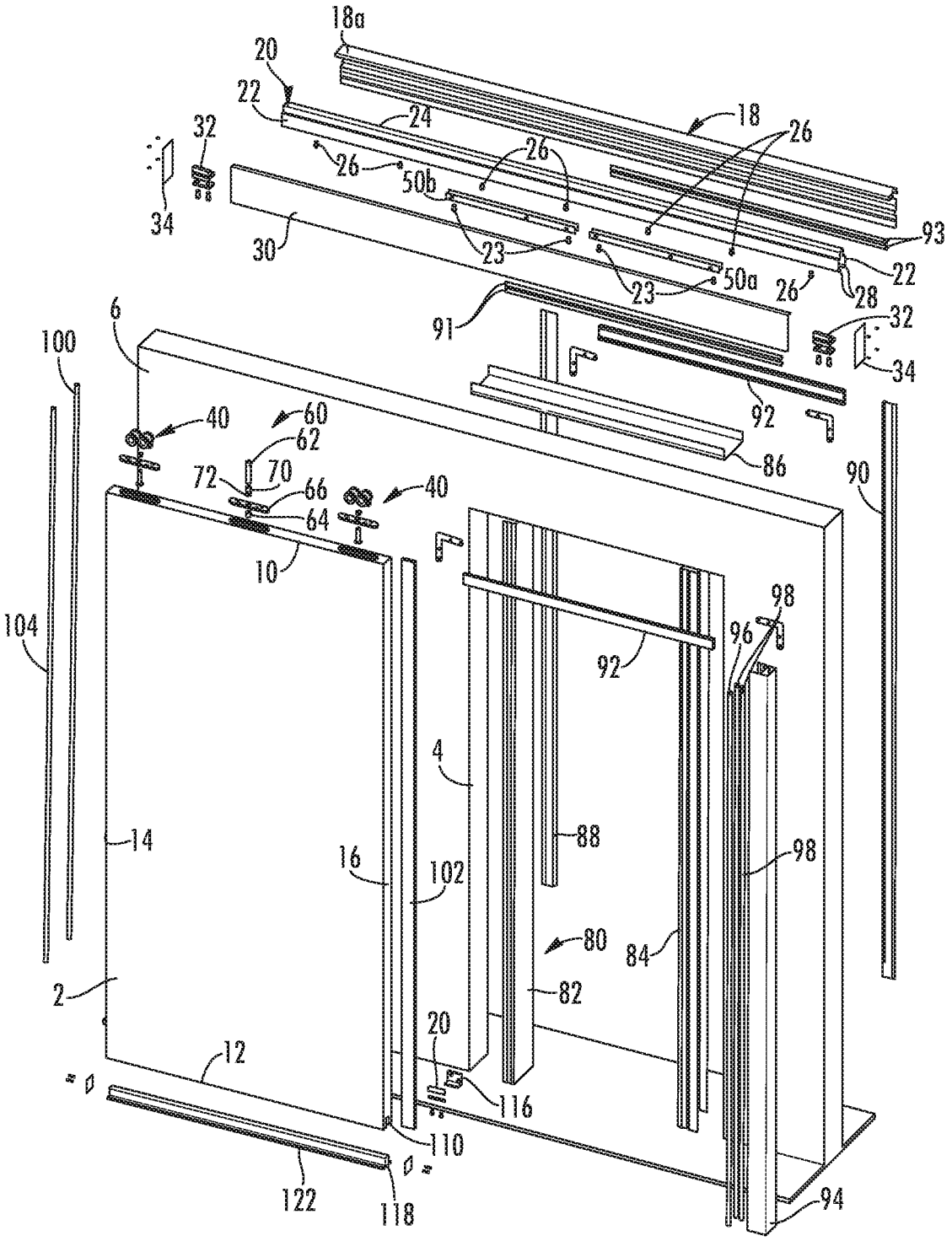
FIG. 4 is an exploded perspective view of the door assembly of FIG. 1.
Figure 5:
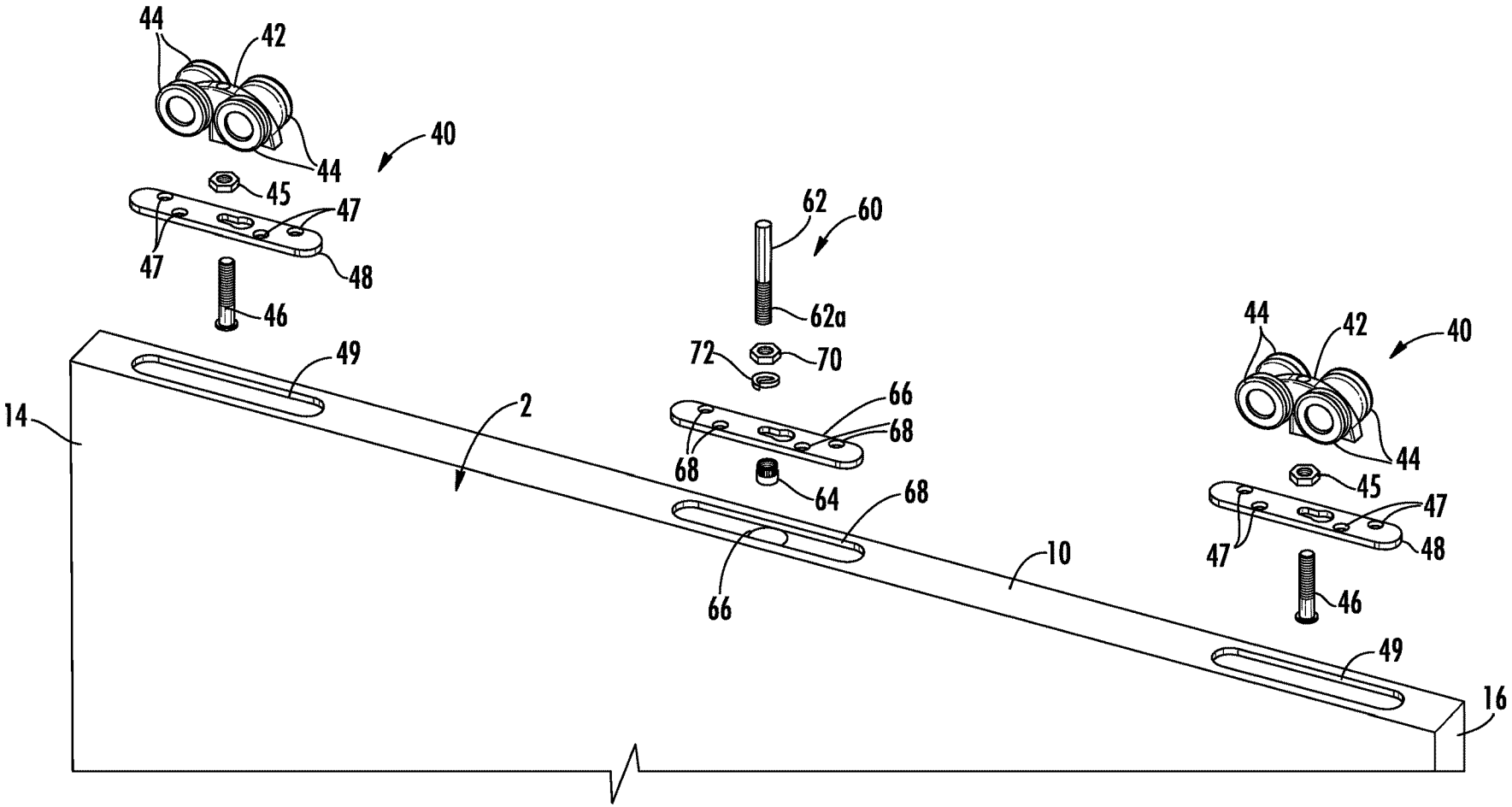
FIG. 5 is a detailed exploded perspective view of the door assembly of FIG. 1.

In one embodiment, the activator pin 62 is located in the center of the door approximately midway between the leading edge 16 and the trailing edge 14 and may be positioned proximate to the vertical centerline of the door. The single activator pin 62 may be used to provide soft close functionality in both the opening direction and in the closing direction such that it is not necessary to provide two activators. While the activator pin is described as being positioned approximately midway between the leading edge 16 and the trailing edge 14 it may be slightly offset from the center of the door to allow the door to overlap with the opening as shown in FIG. 3.

Figure 8:
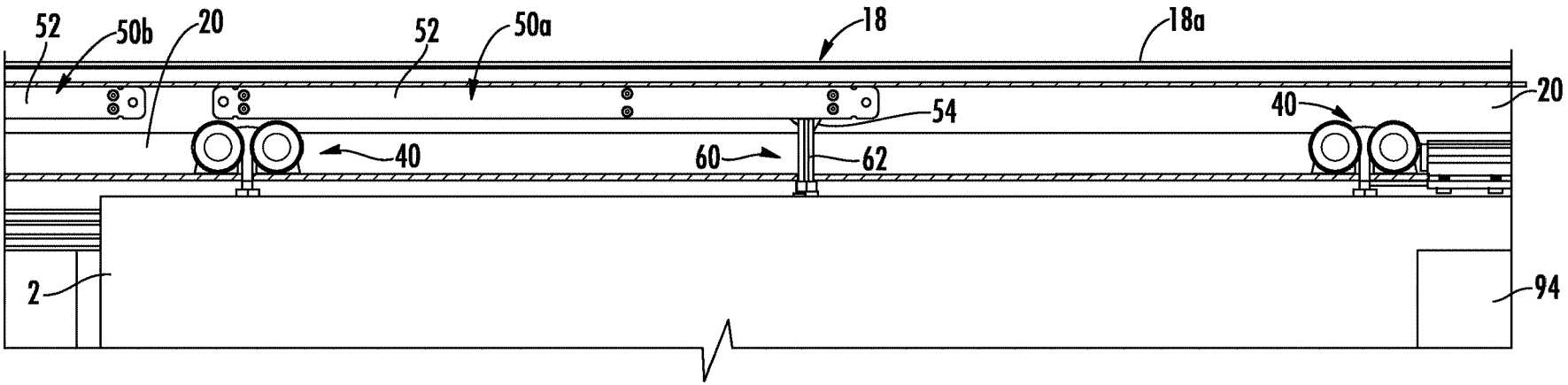
FIG. 8 is a detailed elevation view of the door assembly of FIG. 1 in a fully closed position.
Figure 9:
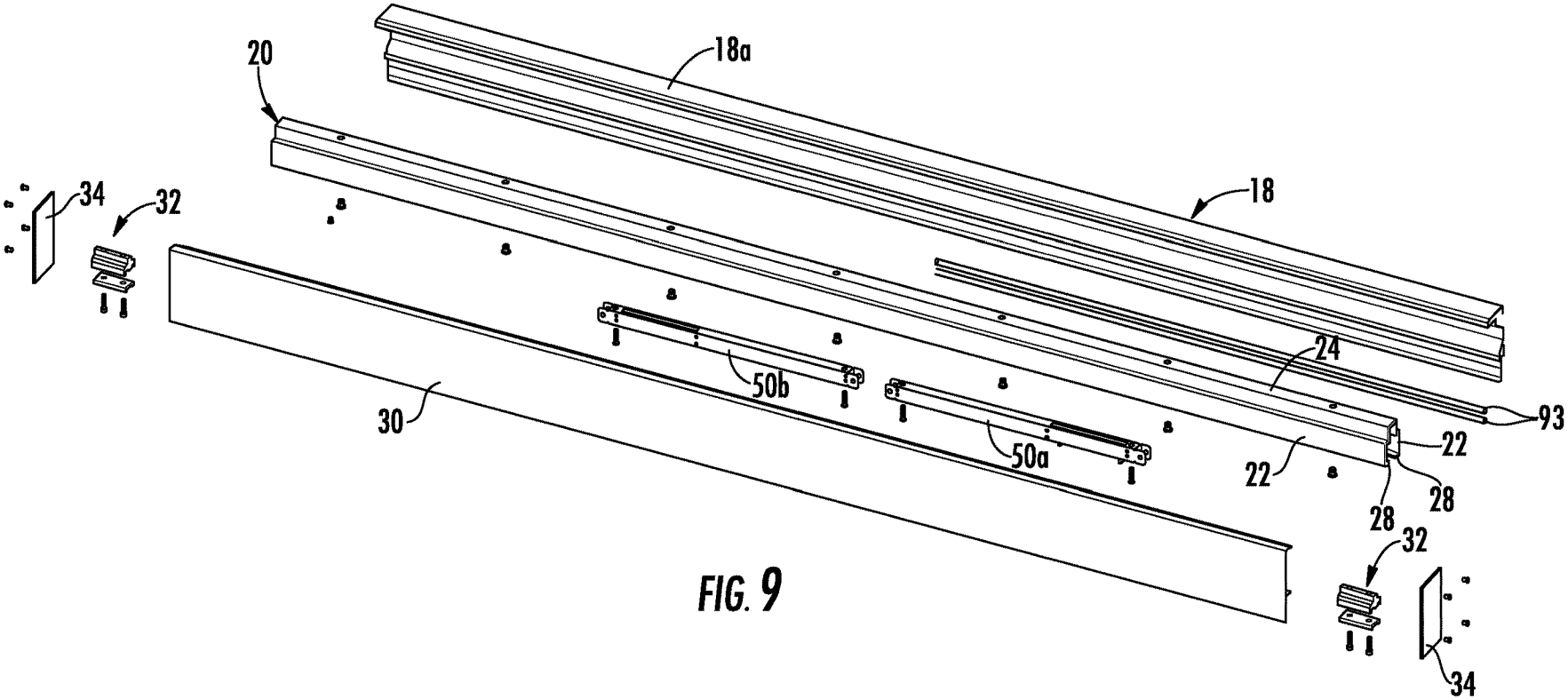
FIG. 9 is a detailed exploded perspective view of the track and associated hardware of the door assembly of FIG. 1.

Referring more specifically to FIG. 6, a pair of soft close devices 50*a*, 50*b* are used in conjunction with the single activator pin 62 such that the single activator pin 62 interacts with both soft close devices. Soft close devices are known and a variety of different types of soft close devices may be used to interact with the activator pin to control the opening and closing of the door. A typical soft close device includes a housing 52 that retains a carrier or catch 54 that is engaged in a first position by the activator pin 62 as the door 2 reaches the end of travel. The carrier or catch 54 is operatively connected to a damping device such as spring, pneumatic or gas cylinder or the like, or combinations of such elements, that move the carrier/catch and the door via the engagement of the carrier/catch with the activator pin, from the first position near the fully closed or near the fully open position to a second position at the fully closed or the fully open positions. As the door moves to the fully closed position the activator pin 62 engages the catch/carrier 54 of the first soft close device 50*a* and when the door moves to the fully open position the activator pin 62 engages the carrier/catch 54 of the second soft close device 50*b*. The soft close device 50*a* moves the door from the first position near the fully closed position (FIGS. 2 and 7) to a second position at the fully closed position (FIGS. 3 and 8). The soft close device 50*b* operates in the same manner for the fully open position. The damping device moves the door in a controlled manner such that the door does not open or close with too much force. The carrier or catch 54 is moved from the second position to the first position by the reverse movement of the door and/or by a separate biasing mechanism. The soft close devices 50*a*, 50*b* are positioned in the track 20 in the upper interior space 21. Set screws 23 engage the soft close devices 50*a* and 50*b* to clamp the soft close devices in position against the track 20.

With a single activator pin approximately centrally positioned on the door, the soft close devices 50 are positioned such that the first soft close device 50*a* is engaged by the activator pin as the door nears the fully closed position and the second soft close device 50*b* is engaged by the activator pin as the door nears the fully open position. When the door is at the halfway point of travel between the fully open position and the fully closed position (FIG. 1), the soft close devices 50*a*, 50*b* are spaced approximately equally from the activator pin 62 allowing for the overlap of the door against the door frame when the door is in the closed position. In some embodiments, the activator pin may be located offset from the centerline of the door. In such an embodiment, the soft close devices may be located in more non-symmetrical positions to maintain the movement of the door. For example, referring to FIG. 1 if the activator pin is moved left of the centerline, the soft close devices may be moved to the left the same distance. The distance between the activator pin and the soft close devices determines the amount of travel the door moves in the opening and closing directions. The actual spacing between the soft close devices 50*a*, 50*b* depends on the width of the door, the width of the opening and the desired amount of travel of the door.

The use of a single activator pin simplifies the installation of the system, minimizes the number of components and makes alignment of the door easier. It will be appreciated that the use of a single activator pin eliminates the need for a second activator pin. Using a single activator also minimizes door preparation because only a single pin activator mounting structure needs to be installed on the door. Moreover, by locating the single activator pin at the center of the door, the angle of the door and the heights of the edges of the door may be adjusted without moving the activator pin significantly relative to the first and second soft close devices making installation of the door easier. Also, using an activator pin that is mounted to the door separate from the trollies, the position of the trollies relative to the door can be adjusted independently of the position of the activator pin relative to the door. In some embodiments, a single soft close device may be used adjacent one of the open and closed positions.

Referring to FIGS. 11 through 16 an integrated guide system and bottom door seal will be described. The door seal may include a bottom door seal 118 that seals the bottom of the door against the floor or other support structure such that the door is sealed about its entire periphery when the door is in the closed position. Bottom door seals are known where the door seal is moved vertically from a retracted position (FIG. 14A) to an extended position (FIG. 14B) when the door is moved to the closed position such that a sealing member 122 of the bottom door seal 118 engages the floor. One example of such a bottom door seal is disclosed in U.S. Pat. No. 6,125,584 issued to Pemko Manufacturing Co. on Oct. 3, 2000 which is incorporated by reference herein in its entirety. The bottom door seal 118 uses a drive mechanism 120 to move sealing member 122 vertically from the retracted position to the extended position. In one embodiment a plurality of springs 124 are used to move the sealing member 120 vertically between the retracted and extended positions. The springs 124 may be mounted between a plurality of blocks 126 where the ends of each of the springs are mounted to the adjacent blocks and the center of the each of the springs is mounted to the sealing member 122. At least one of the blocks is slidable laterally relative to the housing and at least one of the blocks is mounted in a fixed position relative to the housing. A push rod 130 (FIG. 16) is operatively connected to the slide blocks such that when the push rod 130 is moved to actuate the door seal (such as when the door is closed and the push rod engages the vertical wall of channel member 94), the movement of the push rod 130 is transmitted to the slide blocks via the springs 124 such that the slide blocks are also moved laterally. Because the fixed block is fixed in position, the movement of the slide blocks causes the springs to deform such that the springs force the sealing member 122 vertically downward to seal against a floor or other structure. The sealing member 122 may comprise a deformable gasket 132 that deforms into engagement with the floor to create a tight seal. Although a specific example of a bottom door seal has been shown and described it is to be understood that the integrated guide assembly 100 of the invention may be used with any bottom door seal. The gasket 132 may be formed of any suitable compressible, resilient material such as rubber, polymer or the like such that the gasket deforms into engagement with the floor.

The integrated guide assembly 100 comprises a housing 202 that fits into a groove 204 formed in the bottom edge 12 of the door 2. The groove 204 extends along and is open to the bottom edge 12 of the door 2. The groove 204 extends parallel to the direction of travel of the door. Housing 202 fits into the groove 204 such that the housing 202 and the groove 204 extend for the width of the door 2 between the leading and trailing edges of the door. The housing 202 defines a first channel 208 and a second channel 210. Both of channels 208, 210 extend along the length of the housing 202 and for the width of the door 2 and both channels 208, 210 open toward the bottom edge of the door. In one embodiment a common interior wall 212 defines the interior side of both of the channels 208, 210 such that the channels are disposed closely adjacent and parallel to one another to minimize the width of the housing. Channel 208 is further defined by outer wall 214 and channel 210 is defined by outer wall 216. Channel 208 is closed by top wall 218 that extends between the interior wall 212 and the outer wall 214 and channel 210 is closed by top wall 220 that extends between the interior wall 212 and the outer wall 216. In the illustrated embodiment the housing 202 includes a pair of opposed flanges 222, 224 that extend from outer walls 214 and 216, respectively and that may be secured to the bottom edge 36 of the door 2. The flanges may be eliminated such that the housing terminates at the end of or inside of the groove 204. The housing 202 may comprise a unitary one-piece member such that the channel for receiving the guide member and the channel for receiving the bottom seal are part of the same member. For example, in some embodiments, the housing may be an extruded member. As used herein the housing 202 may be considered a unitary one-piece member where the housing 202, including both channels 208 and 210, is made of separate components provided the components are connected together outside of the door and are installed in the door as a unit. For example the housing may be made of planar members secured to one another by welding, crimping, fasteners or the like.

Figure 14A:
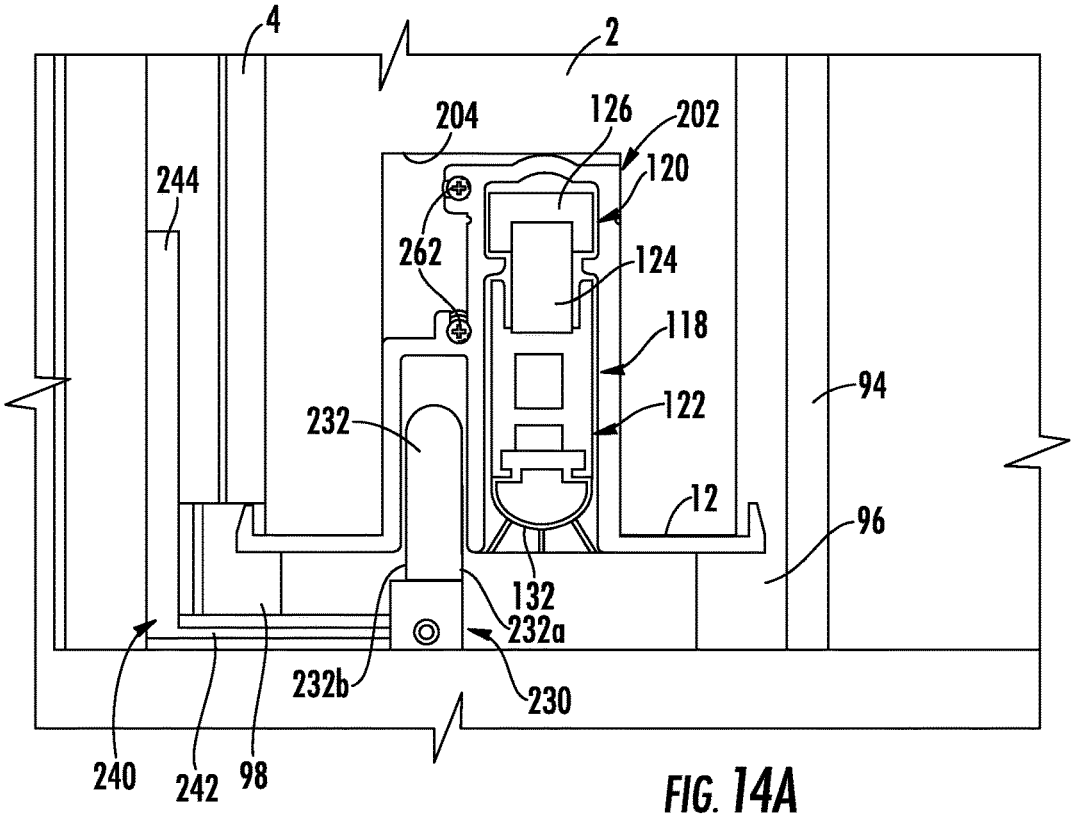
FIG. 14A is an end view of the integrated guide assembly of FIG. 11 with the bottom door seal in a retracted position.
Figure 14B:
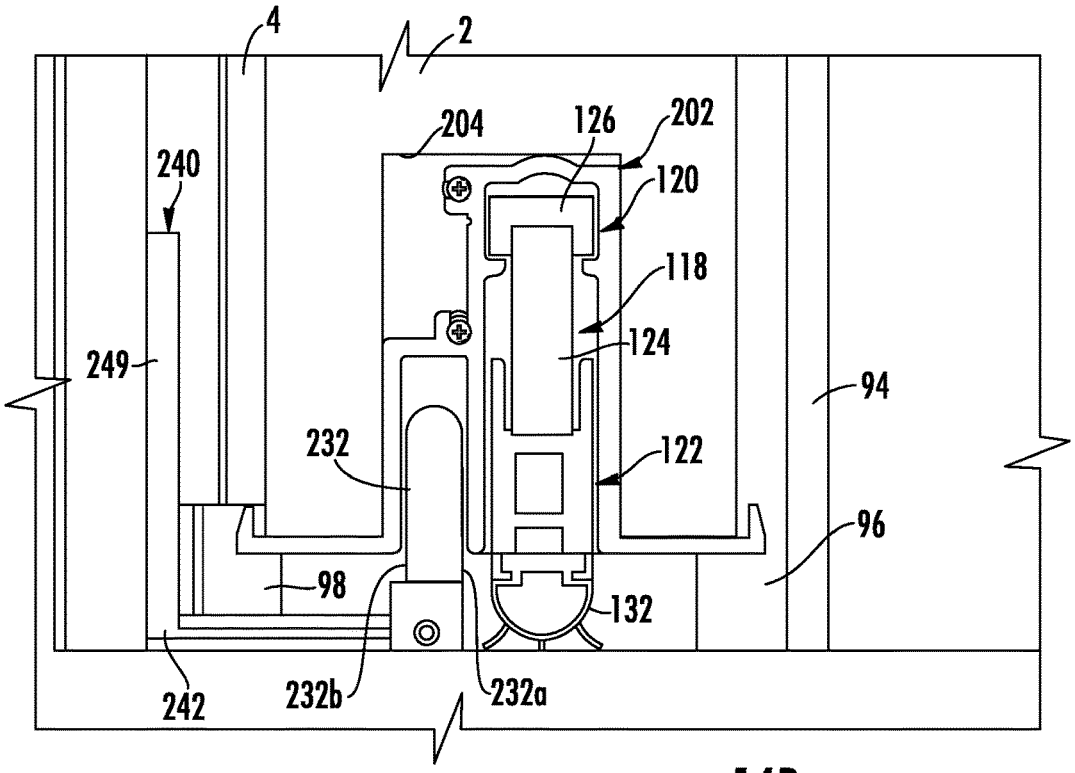
FIG. 14B is an end view of the integrated guide assembly of FIG. 11 with the bottom door seal in an extended position.
Figure 15:
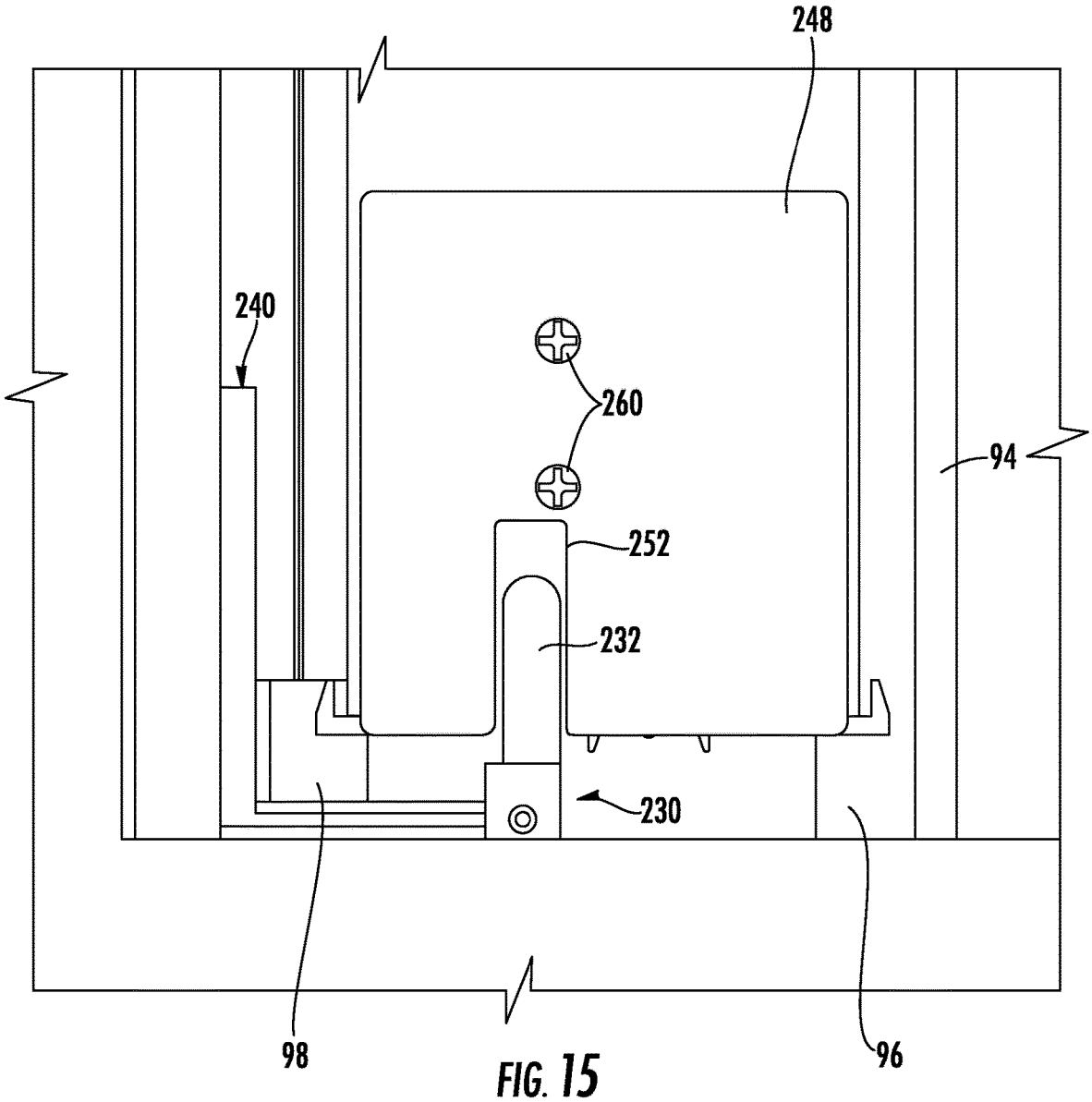
FIG. 15 is an end view of one end of the door showing the integrated guide assembly of FIG. 11 with a cover plate installed.
Figure 16:
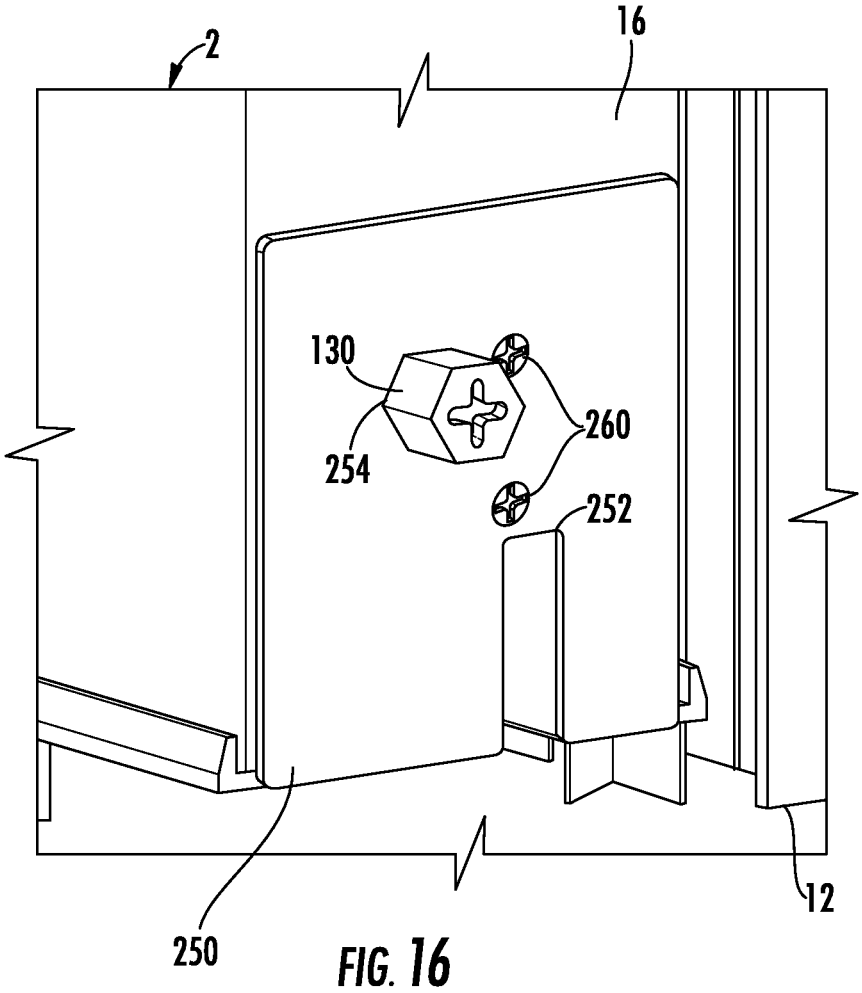
FIG. 16 is a perspective view of the opposite end of the door showing the integrated guide assembly of FIG. 11 with a cover plate installed.
Figure 17:
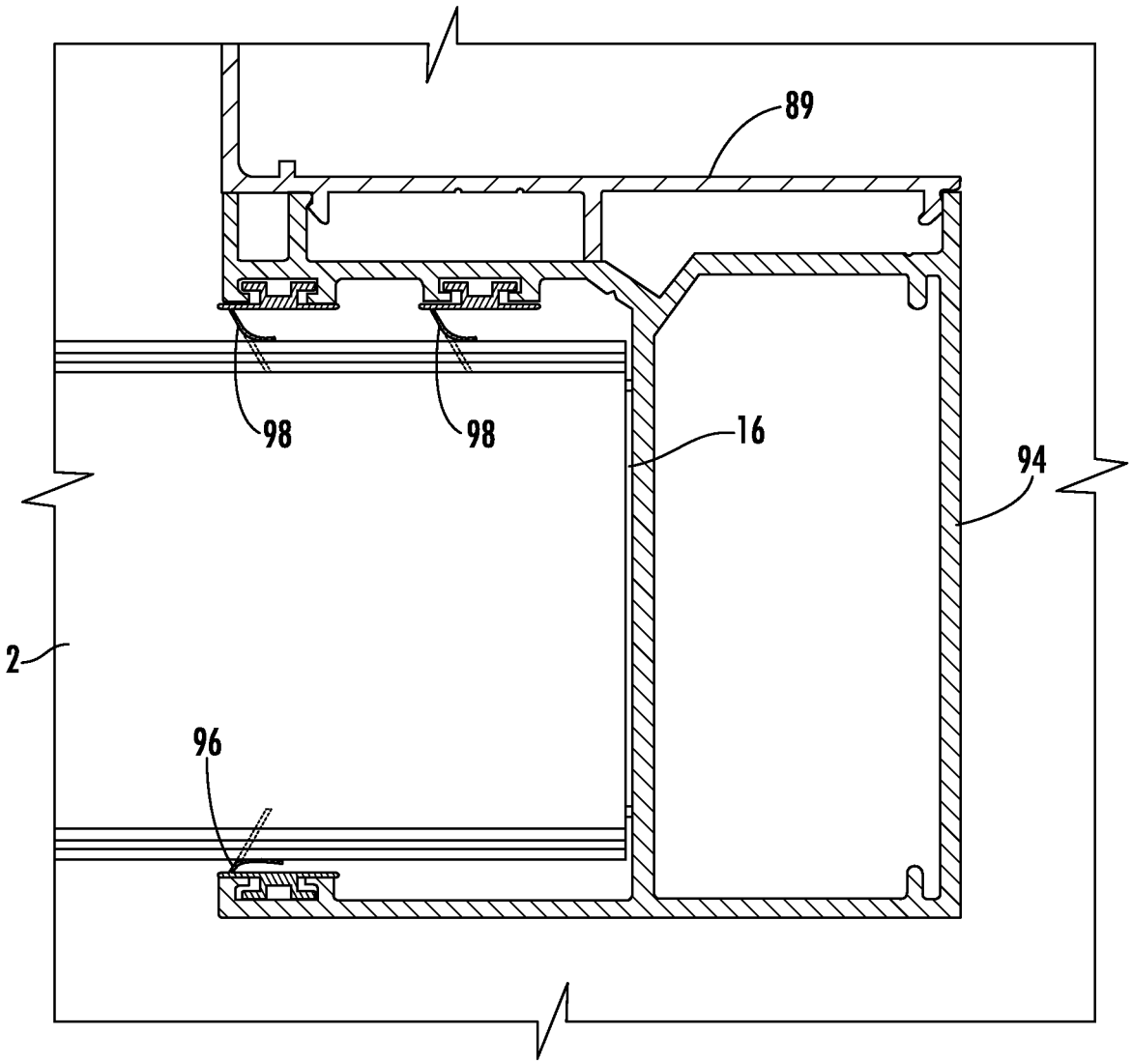
FIG. 17 is a top view of the leading edge of the door in the closed position.

The first channel 208 is dimensioned to receive the bottom seal 118 such that the sealing member 122 may be retracted and extended to seal with the floor or other surface as shown in FIGS. 14A and 14B. The second channel 210 is dimensioned and configured to slidably receive the door guide 230. The door guide 230 comprises an upright guide member 232 that, when engaged with channel 210 maintains the bottom edge of the door in position relative to the wall as the door is opened and closed. In the illustrated embodiment the guide member 232 comprises a flat plate that is closely but slidably received in channel 210. The door guide 230 further comprises a support member 240 that supports the guide member. The support member 240 is arranged such that it does not interfere with the engagement of the sealing member 122 with the floor when the sealing member 122 is extended from the housing.

The support member 240 is positioned such that it extends away from and behind the sealing member 122. In one embodiment the support member 240 comprises an L-shaped member having a horizontal section or leg 242 that may extend along the floor and may be secured thereto and a vertical portion or leg 244 that may be secured to the wall behind the door. It is important for the sealing member 122 to be able to make contact with the floor along its entire length in order to provide a suitable barrier against sound, air, light etc. Therefore, arranging the support 240 such that it does not extend under the sealing member 122 allows the seal to contact the floor in uninterrupted manner. The guide member 232 has a front side 232*a* that faces toward the bottom seal 118 and a back side 232*b* that faces away from the bottom seal 118. In one embodiment, where the channels are disposed closely adjacent to one another the support member 240 does not extend beyond the front side 232*a* such that it does not extend under the sealing member 122.

End plates 248, 250 may be mounted to the side edges of the door 2 to cover the bottom seal. End plate 248 includes a slot 252 to allow the guide member 232 to extend through the end plate. Endplate 250 includes an aperture 254 that allows the push rod 130 to extend through end plate 250. In one embodiment screws 260 may extend through apertures in the end plates and engage threaded holes 262 in the housing 202 to secure the end plates 248, 250 in position.

The integrated guide system and bottom door seal of FIGS. 11-16 may be used with the peripheral door seal and soft close system described with respect to FIGS. 1-10. However, the integrated guide system and bottom door seal, the peripheral door seal and the soft close system may be used independently of one another. When used together the integrated guide system and bottom door seal, the peripheral door seal provide a sealing system that resists the transmission of air, light, sound across the door.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A sliding door system comprising:

a door comprising an inner face, an outer face, a top edge, a leading edge and a trailing edge mounted for sliding movement relative to a door opening formed in a structure between a closed position and an open position;

a housing mounted in the bottom edge of the door, the housing comprising a first channel retaining a bottom seal and a second channel for receiving a guide member;

a guide member received in the second channel, the guide member having a first side that faces the first channel and a second side that faces away from the first channel;

wherein the bottom seal is positioned in the first channel, the bottom seal comprising a sealing member that is moved vertically between a retracted position and an extended position;

a channel member that is disposed generally vertically and receives the leading edge of the door when the door is in the closed position, the channel member comprising at least one first gasket that faces the inner face of the door such that when the door is in the closed position and the leading edge of the door is received in the channel, the at least one first gasket engages the inner face of the door near the leading edge, and at least one second deformable gasket mounted on the door adjacent the trailing edge of the door that extends to the structure to form a seal against the structure adjacent door opening, and at least one third deformable gasket mounted on the structure that extends to the door to form a seal against the door adjacent the top edge of the door.

2. The sliding door system of claim 1 further comprising at least one fourth gasket that faces the outer face of the door such that when the door is in the closed position and the leading edge of the door is received in the channel, the at least one fourth gasket engages the outer face of the door near the leading edge.

3. The sliding door system of claim 1 further comprising a first soft close device mounted adjacent the open position and a second soft close device mounted adjacent the closed position;

an activator pin mounted on the door and positioned such that the activator pin contacts the first soft close device as the door nears the open position and contacts the second soft close device as the door nears the closed position.

4. The sliding door system of claim 1 wherein the guide member forms part of a guide that comprises a vertical portion spaced from the guide member such that a portion of the bottom edge of the door is positioned between the guide member and the vertical portion where the guide does not extend under the door seal.

5. The sliding door system of claim 4 wherein the guide member comprises an upright member.

6. The sliding door system of claim 1 wherein the door has a width and a length and the housing extends for the length and the width of the door, and wherein the first channel and the second channel extend along the length of the housing and both the first channel and the second channel open toward a bottom of the door.

7. The sliding door system of claim 6 wherein the first channel and the second channel share a common wall.

8. A door assembly comprising:

a door mounted for lateral sliding movement between an open position and a closed position;

a first soft close device mounted adjacent the open position and a second soft close device mounted adjacent the closed position;

an activator pin mounted on the door and positioned such that the activator pin contacts the first soft close device as the door nears the open position and contacts the second soft close device as the door nears the closed position.

9. The door assembly of claim 8 wherein the activator pin is mounted to a top edge of the door.

10. The door assembly of claim 8 wherein the activator pin comprises a threaded end that is threaded into a threaded sleeve on the door such that rotation of the activator pin changes the height of the activator pin relative to the door.

11. The door assembly of claim 8 wherein the door has a leading edge and a trailing edge and the activator pin is positioned between the leading edge and the trailing edge.

12. The door assembly of claim 8 further comprising a first trolley is mounted to a top edge of the door; a second trolley mounted to the top edge of the door and spaced from the first trolley; where the activator pin is mounted to the top edge of the door midway between the first trolley and the second trolley.

13. A method of operating a door assembly comprising a door mounted for lateral sliding movement between an open position and a closed position, a first soft close device mounted adjacent the open position, a second soft close device mounted adjacent the closed position, and an activator pin mounted on the door, the method comprising:

moving the door in a first direction such that the activator pin contacts the first soft close device as the door nears the open position and moving the door in a second direction such that the activator pin contacts the second soft close device as the door nears the closed position.

* * * * *